US005342232A

United States Patent [19]

Bardot

[11] Patent Number: 5,342,232

[45] Date of Patent: Aug. 30, 1994

[54] SWIM TRAINING DEVICE

[76] Inventor: James P. Bardot, 302 Cozumel, Laguna Beach, Calif. 92651

[21] Appl. No.: 54,435

[22] Filed: Apr. 30, 1993

[51] Int. Cl.[5] ..... B63C 9/08

[52] U.S. Cl. ..... 441/115; 434/254; 441/106

[58] Field of Search ..... 434/254; 441/88, 90–101, 441/106–119, 129–132, 136

[56] References Cited

U.S. PATENT DOCUMENTS

| | | | |
|---|---|---|---|
| 1,538,627 | 5/1925 | Di Lauro | 441/114 |
| 1,932,708 | 10/1933 | Phillips, Jr. | 441/113 |
| 2,426,726 | 9/1947 | Combs | 441/102 |
| 3,179,963 | 4/1965 | Peterson | 441/115 |
| 3,425,072 | 2/1969 | Carlson | 441/114 |

FOREIGN PATENT DOCUMENTS

| | | | |
|---|---|---|---|
| 666680 | 7/1963 | Canada | 434/254 |
| 6707 | of 1890 | United Kingdom | 441/115 |

*Primary Examiner*—Edwin L. Swinehart
*Attorney, Agent, or Firm*—Francis X. LoJacono

[57] ABSTRACT

A swim training device for teaching a novice swimmer to swim that includes a pair of buoyancy units that are defined as a pair of interconnected pouches adapted to removably store a plurality of floatation cells. The pouches are adjustable to the size of the wearer and to the changing size of the pouch as selective floatational cells are removed. The swim training device further provides a new method of training for progressively teaching novice swimmers, especially children, the basic swimming skills.

6 Claims, 1 Drawing Sheet

SWIM TRAINING DEVICE

BACKGROUND OF THE INVENTION

1. Field of the Invention

The present invention relates generally to a training device for teaching children to swim and more particularly to a swim training device which includes a plurality of floatation cells that are removably positioned within a pair of interconnected pouches. The pouches are adjustable to the size of the wearer and to the changing size of the pouch as selective floatational cells are removed. The swim training device further provides a new method of training novice swimmers, especially children.

2. Description of the Prior Art

Many types of swim training devices, which are also referred to as swim training aids, are presently in use. The list of such devices consists of buoyancy rings, floatational swim suits, floatational arm bands, water wings, back packs, float boards, and other personal floatational devices. Most of these floatation apparatuses provide means for buoyancy while a student develops swimming skills. Thus, there are many types of swim training aids that incorporate different structural and configurational arrangements. However, the structures of these training devices have features that often restrict their use.

These restrictions cause some devices to become awkward and bulky, thus interfereing with learning, or do not teach skills directly pertinent to those needed for learning to swim. In essence, they can be self-defeating, causing anxiety, confusion, and loss of confidence in the swim training device and/or the student's own abilities Ultimately, the student's safety is jeopardized when he/she must eventually forsake the last of these support devices while possessing only marginal swimming abilities.

Additionally, changing or replacing familiar flotation devices with new ones as the student develops often creates temporary setbacks, loss of confidence, and anxiety while the gap is bridged and the student must relearn using a new system. No current system employs a concealed, measurable (i.e., specific and consistent), and removable buoyancy device that allows the student to develop skills progressively, naturally, and without realizing the fact that he/she is learning.

Although other swim training and buoyancy devices have been used which employ the concept of a removable buoyancy, none have been developed in which the buoyant material is concealed and yet provides a means by which removal thereof can be accomplished in small increments without being noticed by the wearer of the device. At present, there has been nothing developed wherein the buoyant material is specific and numbered, and the density can be measured and recorded to monitor the progress of the wearer. Finally, no device has been developed which includes a program outlining a specific method of use.

Further in this connection, the following are U.S. Pat. Nos. that disclose various types of floatation devices.

1,252,842, LIFE PRESERVER to W. G. Richardson;
1,301,831, LIFE PRESERVER to H. W. Gain;
1,394,180, LIFE PRESERVER to A. P. Lundin;
1,538,627, SWIMMING DEVICE to B. Di Lauro;
1,552,603, FLOAT to B. A. Hawks;

1,704,368, LIFE PRESERVER to J. Murphy;
2,118,165, SELF INFLATING LIFE PRESERVER to E. T. Christopher et al;
2,871,491, SWIM TRAINER to J. Van Vorst;
3,140,549, SWIMMING INSTRUCTION GARMENT to D. J. Wayfield;
3,179,963, BUOYANT SWIMMING VEST to K. Peterson;
3,181,183, LIFE JACKET to M. R. Allen; and
3,903,555, SWIMMING AID to D. H. Busby.

The majority of these patented inventions relate generally to life preservers and swimming aid devices. However, these devices do not provide a simple means for progressively teaching swimming skills to a trainee that allow the trainee to develop at his or her individual rate.

SUMMARY AND OBJECTS OF THE INVENTION

The present invention comprises a pair of buoyancy units defined by a pair pouches that are adapted to receive and store a plurality of removable floatation cells or panels. The two pouches are attached together by means of an interconnecting adjustable drawstring or other suitable adjustable connecting means, whereby the two buoyancy units can be mounted about an individual's chest.

One unit is positioned over the chest area and the other unit is positioned over the back area of the swimmer. By removing selective floatation cells one can gradually learn how to swim with confidence. By selectively removing the floatation cell or panels one can control the swimmer's position in the water from a vertical stance to either a reclining supine position or an inclined prone position. This arrangement, not previously provided with other known floatation devices, allows the swimmer to learn various types of swimming strokes in either the prone or supine position.

It is an important object of the present invention to provide a training device that allows a novice swimmer the ability to quickly learn the basic strokes while at the same time quickly establishing self-confidence in the ability to float freely without the aid of others.

Another object of the invention is to provide a swim training device for children which allows the concealed floatational cells to be selectively removed from the pouches without the wearer being aware that the cells have been removed from the pouches.

Still another object of the invention is to provide an apparatus for teaching and training an individual to swim using a pair of the pouches. The inner surface (side nearest the wearer) of each pouch is made of a nonstretchable sheet of nylon or other suitable nonstretchable material, and the outer sheet is made of stretch-type fabric which expands to accommodate the floatational cells or panels whereby the cells are securely stacked within the respective pouches. This arrangement of the pouches also reduces the hydrodynamic drag and increases the performance of the training device and the wearer. Because of the stretchable properties of the material on the outer side of the pouch and the cells disposed therein, the pouch creates a "bow" shape which conforms to the shape of the wearer, thereby insuring a snug fit that offers the wearer a greater sense of security.

Yet another object of the present invention is to provide an apparatus of this character that includes a means for securing the pouches in a relatively fixed position to the torso of the wearer so as not to interfere with body movement or mobility while in the water.

A further object of the invention is to provide a training device of this character that is simple to use and not complicated in its structure, allowing for the simple removal to each floatational cell or panel as the wearer progresses in his or her swimming skills. The exact amount of buoyancy required is always provided down to the final few ounces, allowing, safe, predictable, and reliable progression to free swimming.

A still further object of the invention is to provide a training device of this character which allows the pouches to be easily positioned on the front or rear of the student's body, whereby the pouches can be adjusted so as to position the wearer from a vertical mode to either an inclined supine mode or an inclined prone mode.

It is still a further object of the present invention to provide a training device of this type that is relatively inexpensive to manufacture, is simple but rugged in construction, and is easy to maintain.

The characteristics and advantages of the invention are further sufficiently referred to in connection with the accompanying drawings, which represent one embodiment. After considering this example, skilled persons will understand that variations may be made without departing from the principles disclosed; and we contemplate the employment of any structures, arrangements or modes of operation that are properly within the scope of the appended claims.

DESCRIPTION OF THE PREFERRED EMBODIMENT

Figure 1:
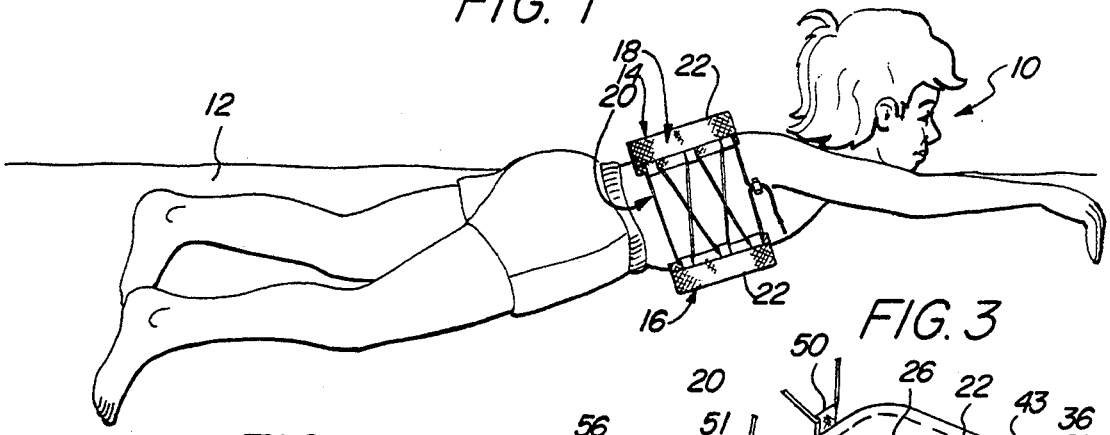
FIG. 1 is a side elevational view showing a novice swimmer in a prone position wearing the present invention mounted on the upper torso about the chest and back.

Referring first to FIG. 1 of the drawings, there is shown a novice swimmer, generally indicated at 10, swimming in a typical prone position in a body of water, designated at 12. The present invention is shown mounted around the wearer's upper torso and defines a swim training device, indicated generally at 14, for the non-skilled swimmer. The swim training device 14 comprises a pair of buoyancy units which are respectively numbered 16 and 18. These units are made identical to each other and their structure is the same so that the description of one will suffice for both units. Since the buoyancy units are the same in all respects, this allows the wearer to position units 16 and 18 as desired without concern as to which unit is positioned on the front (chest) and which goes on the back. However, when the individual units are first floatationally adjusted, thereafter they should be worn according to their floatational arrangement in order to provide an uninterrupted training sequence, as will hereinafter be discussed. For simplicity, unit 16 is shown positioned over the wearer's chest and the second unit 18 is located on the wearer's back. The two buoyancy units are interconnected by a body securing means, designated at 20, which allows training device 14 to be positioned and adjusted about the upper body of the wearer.

Accordingly, each unit is defined as a pouch or envelope 22 formed from two cover sheets and a closure member. The first cover sheet will be referred to as the outer cover sheet 24 and the second cover sheet will be referred to as the inner cover sheet 26 which is the side of the pouch that is positioned adjacent the body of the wearer. The two cover sheets are made from suitable fabrics or materials, the outer cover sheet 24 being preferably made from a stretchable fabric or other suitable elastic material, and the inner cover sheet 26 being made from a suitable nonstretchable fabric or material. The two cover sheets 24 and 26 are attached by suitable means such as sewing them together along their respective outer peripheral edges 28 and 30.

The stretchable outer elastic cover sheet 24 forms a deep first compartment section in the pouch. That is, outer cover sheet 24 is defined by an enlarged and substantially flat wall member 32 having two elongated side wall members 34, a rear wall member 36, and a front wall member 38. The inner cover sheet 26 forms a shallow compartment section which is defined by an enlarged and substantially flat wall member 40 having two elongated shallow side wall members 42, shallow rear 43, and front wall member 44 that are attached to the respective wall members 34, 36 and 38 of outer cover 24. When the outer and inner cover sheets are secured together each pouch 22 is formed having an enlarged single storage compartment 45, as illustrated in FIG. 2.

Figure 2:
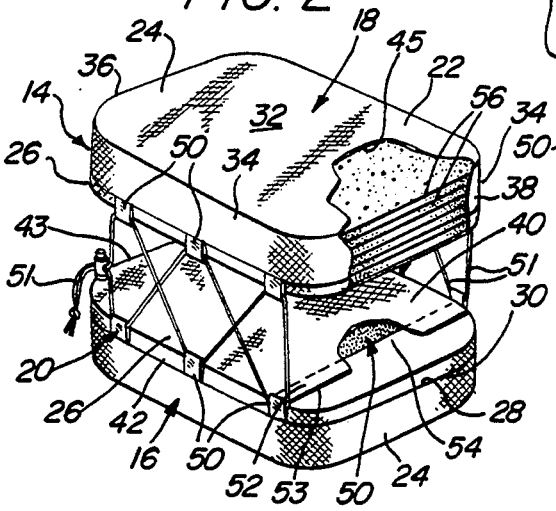
FIG. 2 is a pictorial view of the two pouches spaced apart and connected by the adjusting cords, portions of each pouch being broken away to show the internal position of the floatational cells mounted therein.
Figure 3:
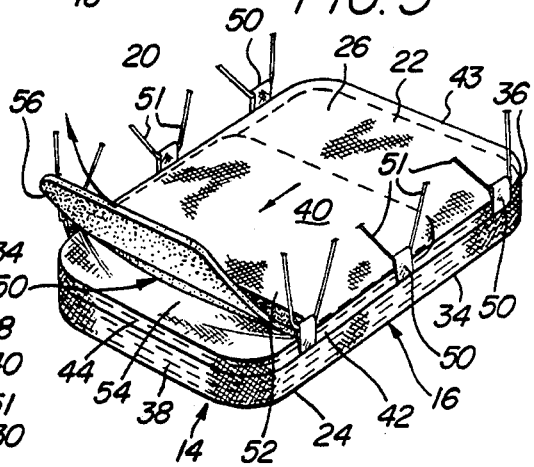
FIG. 3 is a pictorial view of one of the floatation pouches showing a floatational cell being removed therefrom.

Moreover, inner cover 26 is provided with an entrance or opening, indicated at 50, which is positioned adjacent the forward portion of the pouch, as illustrated in FIGS. 2 and 3, that defines a slot 53 which is provided by a pair of overlapping lip members 52 and 54 which are formed as part of the inner cover member 26. This allows access to compartment 45, whereby a plurality of cells 56 may be stored in or removed from each of the buoyancy units 16 and 18, as also shown in FIGS. 2 and 3.

Figure 4:
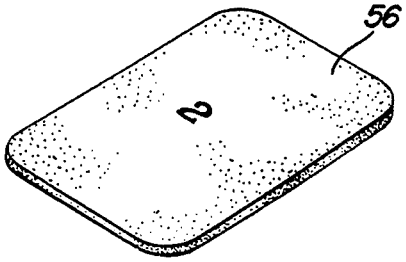
FIG. 4 is a perspective view of one of the floatational cells having a numerical mark placed thereon.

Each pouch is arranged to receive a plurality of floatational cells or panels 56, each having a general rectangular configuration and a size preferably between six to seven inches in width, approximately nine to ten inches in length, and a thickness of at least a quarter of an inch. One of many suitable cellular foam materials can be used as the cell structure. Further, each floatational cell or panel is provided with a sequential marking such as numerals, as indicated at 58 in FIG. 4. The marking provides an aid to the method of training one to swim.

Buoyancy units 16 and 18 are adjustably connected to each other by body securing means 20 that can of any suitable arrangement that allows the pouches to be firmly positioned about the upper torso of the wearer, as illustrated in FIG. 1.

In the embodiment, as indicated in FIGS. 1, 2 and 3, securing means 20 comprises a plurality of loop members 50 fixedly attached to the elongated sides of each respective pouch like unit 16 and 18. There are three loop members shown mounted along the sides of the pouches and are connected by means of an elastic drawstring or cord 51 which is laced through loops 50 in a crisscross arrangement. Accordingly, each side of interconnected units 16 and 18 includes aligned loop members 50 and an elastic cord 51 for adjusting, the two buoyancy units firmly in place about the body of the swimmer 10, as illustrated in FIG. 1. Once adjusted, the two oppositely disposed cords 51 are provided with a locking means, designated at 54, that secures the cords in a tight fixed arrangement, whereby the pouches are held in place under the elastic force of the cords, as mentioned heretofore.

Figure 5:
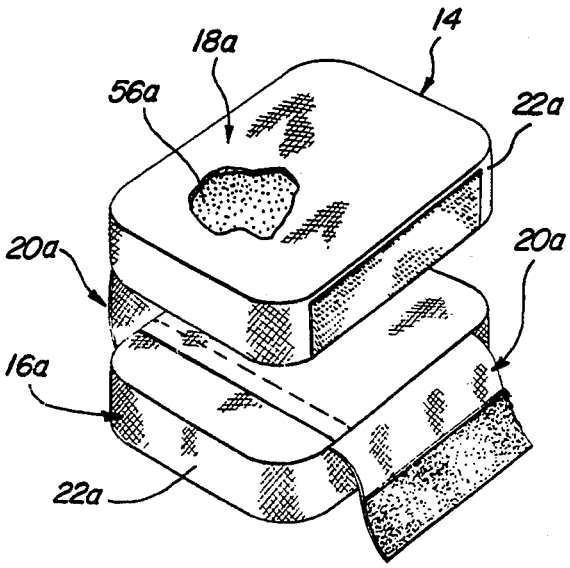
FIG. 5 is a pictorial view of a second embodiment of the present invention.

Referring now to FIG. 5, there is illustrated a second embodiment of the present invention in which the pair of buoyancy units **16*a* and 18*a* have an outer cover sheet of elastic material 24*a* forming a deep compartment section in the pouch. That is, outer cover sheet 24*a* is defined by an enlarged and substantially flat wall member 32*a* having two elongated side wall members 34*a*, and a rear and front wall member 36*a* and 38*a*, respectively. An inner cover sheet 26*a* defines a nonelastic inner wall that is a substantially flat member 40 but does not include shallow side wall members as found in the first embodiment of the invention. When the outer and inner cover sheets are secured together each pouch 22*a* forms an enlarged storage compartment 45*a* in which floatational cells or panels 56*a* are removably stored, as illustrated in FIG. 5**.

Securing means **20*a* in this embodiment comprises an elastic sheet 60 attached along one of the longitudinal edges 62 of the unit. The outer edge of sheet 60 is covered with a VELCRCO® type securing material which is also often referred to as a loop-and-hook fastening material. Accordingly, one of the fastening material members 62 is attached to sheet 60 along one side of the floatational unit and the second fasting material 64 is mounted to the opposite side wall which is illustrated in FIG. 5. This allows the two units 16*a* and 18*a*** to closely fit about the swimmers body. It should be noted that other suitable securing means can be employed.

When the present invention is to be used a selected number of floatational cells or panels 56 of from one to nine, in numerical order, are inserted into each pouch 22. The number of cells is determined by the swimming skill of the one who is to use the swim training device. That is, if a novice swimmer has no skills in swimming then each pouch of the training device 14 would have the full number of nine panels stored therein. The device is then positioned about the upper torso of the swim trainee, at which time the drawstrings or cords 51 are tightened so that each buoyancy unit 16 and 18 is firmly adjusted to provide a snug fit about the chest of the swimmer 10. Thus, all of the cells or panels are hidden from view of the trainee. As the swim trainee progresses in his or her skills, a selected number of floatational panels are removed so that the swim trainee proceeds from a passive buoyancy to a natural unaided condition without the wearer's conscious awareness. In essence, the wearer is self-taught to swim.

Since, the floatational panels are sequentially numbered or otherwise identified, the exact buoyancy measurement can be adjusted to the trainee's initial buoyancy and swimming ability, which contributes to maximizing the wearer's learning and personal comfort.

It may thus be seen that the objects of the present invention set forth herein, as well as those made apparent from the foregoing description, are efficiently attained, While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What I claim is:

1. A swim training device arranged to be worn about the upper torso of a swim trainee comprising:

a pair of buoyancy units defining a front and rear pouch, each formed by a first and second cover sheet that defines a storage compartment;

a plurality of floatational cells removably stored in each of said storage compartments so as to sequentially control the buoyancy of each of said buoyancy units, the number of floatational cells being concealed from the swim trainee; and means for attaching said pair of buoyancy units to each other, said attaching means further defining means for securing said training device about the body of the wearer thereof;

wherein said first cover sheet includes a concealed opening therein which is located in said pouch so as to engage the body of the swim trainee, and wherein said second cover sheet is located outwardly of said pouch; and wherein said first cover sheet is formed from a nonstretchable material, and wherein said second cover sheet is formed from a stretchable elastic material, whereby the pouch adjustably conforms to the number of flotation cells stored therein.

2. A swim training device as recited in claim 1, wherein said attaching means and said securing means comprise:

an extended elastic sheet material attached to one side of each of said pouches so as to extend outwardly therefrom; and a two-piece fastening material, wherein a first piece is defined as a loop-fastening material and a second piece is defined as a hook-fastening material, and wherein one of said fastening materials is mounted to said extended elastic sheet material and said other fastening material is mounted to the corresponding opposite side of said pouch, whereby said loop fastening material mounted on one of said pouches is positioned to engage said hook-fastening material mounted to the other said pouch.

3. A swim training device arranged to be worn about the upper torso of a swim trainee comprising:

a pair of buoyancy units, each being defined as a pouch formed from a first and second cover sheet that defines a storage compartment having an opening therein;

a plurality of floatational cells removably stored in said storage compartment so as to sequentially control the buoyancy of each of said buoyancy units, the number of floatational cells being concealed from the swim trainee; and means for attaching said pair of buoyancy units to each other, said attaching means further defining means for securing said training device about the body of the wearer thereof; wherein said first cover sheet includes said concealed opening therein positioned so as t engage the body of the swim trainee, and wherein said second cover sheet is located outwardly of said pouch;

said first cover sheet being formed from a nonstretchable material, and wherein said second cover sheet is formed from a stretchable elastic material, whereby the pouch adjustably conforms to the number of floatation cells stored therein; and wherein said attaching means and said securing means comprise:

a plurality of loop members located along opposite outer sides of said pouches and extending outwardly from said first cover sheet;

a drawstring laced through said loop members in a crisscross arrangement on each side of said pouch, whereby said buoyancy units are held firmly against the body of the trainee; and locking means mounted on said drawstring, whereby said drawstring is held in a selected tight arrangement, causing said buoyancy units to snugly fit the wearer thereof.

4. A swim training device as recited in claim 3, wherein said drawstring is an elastic cord.

5. A swim training device as recited in claim 4, wherein said floatational cells are sequentially marked with indicia.

6. A swim training device as recited in claim 5, wherein said indicia is defined by numerals whereby the progression of the skill level of the trainee is measured and monitored.

* * * * *